US005794530A

United States Patent [19]

Dobashi et al.

[11] Patent Number: 5,794,530

[45] Date of Patent: Aug. 18, 1998

[54] THERMAL TRANSFER PRINTER HAVING INTERMEDIATE TRANSFER MEMBER

[75] Inventors: Koichi Dobashi; Isao Owada; Hiroyoshi Zama, all of Iwate-ken, Japan

[73] Assignee: Alps Electric Co., Ltd., Japan

[21] Appl. No.: 727,806

[22] Filed: Oct. 7, 1996

[30] Foreign Application Priority Data

Oct. 12, 1995 [JP] Japan ..... 7-264071

[51] Int. Cl.[6] ..... B41F 1/30

[52] U.S. Cl. ..... 101/409; 400/120.01; 101/415.1

[58] Field of Search ..... 101/409, 415.1, 101/410, 411, 412; 400/120.01

[56] References Cited

U.S. PATENT DOCUMENTS

| | | | |
|---|---|---|---|
| 117,566 | 8/1871 | Plunket | 101/409 |
| 4,233,899 | 11/1980 | Rebel | 101/409 |
| 4,330,798 | 5/1982 | Heyer et al. | 101/415.1 |
| 4,357,870 | 11/1982 | Rudolph et al. | 101/409 |
| 5,029,834 | 7/1991 | Boldrini et al. | 101/409 |
| 5,402,217 | 3/1995 | Kimura et al. | 101/409 |
| 5,711,625 | 1/1998 | Takahashi | 400/120.01 |

*Primary Examiner*—Edgar S. Burr
*Assistant Examiner*—Leslie Grohusky
*Attorney, Agent, or Firm*—Brinks Hofer Gilson & Lione

[57] ABSTRACT

A thermal transfer printer comprises an intermediate transfer roller, a thermal print head for transferring portions of an ink layer formed on an ink ribbon to the circumference of the intermediate transfer roller in ink dots, and a pressure drum to be pressed against the intermediate transfer roller to transfer the ink dots from the intermediate transfer roller thereto, provided with grippers on its circumference and with end plates each having a cam section. The cam sections have a height from the circumference of the pressure drum greater than that of the upper ends of the grippers from the circumference of the pressure drum at its opposite ends to avoid the collision of the grippers with the intermediate transfer roller, and have a radially outward convex curved shape. The length of the bases of the cam sections is greater than the distance between two edges between the circumference of the pressure drum and the flat surface formed by cutting a portion of the circumference of the pressure drum.

11 Claims, 9 Drawing Sheets

THERMAL TRANSFER PRINTER HAVING INTERMEDIATE TRANSFER MEMBER

BACKGROUND OF THE INVENTION

1. Field of the Invention

The present invention relates to a thermal transfer printer and, more particularly, to a thermal transfer printer which melts selectively portions of an ink layer formed on an ink ribbon by heat applied thereto by a thermal print head so that ink dots are formed on an intermediate transfer medium, and then transfers the ink dots from the intermediate transfer medium to a recording sheet for desired recording.

2. Description of the Prior Art

There has been a known thermal transfer printer of an intermediate transfer type as shown in FIG. 12 which melts selectively portions of an ink layer formed on an ink ribbon by heat applied thereto by a thermal print head so that ink dots are formed on an intermediate transfer medium, and then transfers the ink dots from the intermediate transfer medium to a recording sheet for desired recording.

Referring to FIG. 12, in this known thermal transfer printer, an intermediate transfer roller 1 formed by coating the circumference of a cylindrical member made of a metal with a rubber layer which serves as an intermediate transfer medium is supported for rotation, and a heater 2 for heating the intermediate transfer roller 1 is disposed inside the intermediate transfer roller 1. The thermal print head 3 has a plurality of heating elements arranged in a line and is disposed near the circumference of the intermediate transfer roller 1 so that the heating elements correspond to a line of contact between the intermediate transfer roller 1 and a horizontal plane tangent to the circumference of the intermediate transfer roller 1. A pair of ribbon rolls 4a is disposed on the transversely opposite sides of the thermal print head 3, respectively, to extend an ink ribbon 5 substantially linearly through a space between the intermediate transfer roller I and the thermal print head 3.

A pressure drum 7 is supported for rotation and pressed by a high pressure against a portion of the circumference of the intermediate transfer roller 1 diametrically opposite a portion of the same corresponding to the heating elements of the thermal print head 3. The pressure drum 7 is driven for rotation by a stepping motor, not shown. A heater 10 for heating the pressure drum 7 is disposed inside the pressure drum 7. As shown in FIG. 13, the pressure drum 7 is provided on its circumference with a gripper 9 that clamps one end of a specified recording sheet 8, such as a plain paper sheet.

The ink ribbon 5 employed in this known thermal transfer printer is a color ink ribbon having a repetitive arrangement of a four-color segment consisting of four color sections, i.e., a yellow (Y) sections a magenta (M) section, a cyan (C) section and a black section (Bk). This known thermal transfer printer prints Y ink dots, M Ink dots, C ink dots and Bk ink dots sequentially in that order. Therefore, the ink ribbon 5 is wound so that the leading edge of the Y section is placed first opposite to the thermal print head 3. The four color sections of the ink ribbon 5 are identified by detecting markers, not shown, printed on boundary lines between the contiguous color sections by a photosensor or the like.

The pressure drum 7 clamping one edge portion of a recording sheet 8 with the gripper 9 is rotated to wrap the recording sheet 8 around the pressure drum 7, the coincidence of a print starting position on the recording sheet 8 with a printing position corresponding to the thermal print head 3 is detected by a sensor, not shown, and the pressure drum 7 is stopped temporarily upon the coincidence of the print starting position with the printing position. Then, the pressure drum 7 is pressed against the intermediate transfer roller 1 by a high pressure, the ink ribbon 5 is fed at a fixed speed from one of the ribbon rolls 4a, the ink ribbon 5 is taken up by the other ribbon roll 4a, and the heating elements of the thermal print head 3 are energized selectively according to desired recording signals to melt portions of the Y ink layer of the Y section of the ink ribbon 5 so that dots 6 of the Y ink are transferred to the circumference of the intermediate transfer roller 1. The dots 6 of the Y ink are transferred from the intermediate transfer roller 1 to the recording sheet 8 pressed against the intermediate transfer roller 1 by the pressure drum 7.

After the dots 6 of the Y ink have been transferred from the intermediate transfer roller 1 to the recording sheet 8, the ink ribbon 5 is advanced to place the leading edge of the M ink section opposite to the thermal print head 3. Then, the same thermal transfer printing cycle as that carried out for forming the dots 6 of the Y ink on the intermediate roller 1 and transferring the dots 6 of the Y ink from the intermediate transfer roller 1 to the recording sheet 8 is repeated to form dots 6 of the M ink on the intermediate transfer roller 1 and to transfer the dots 6 or the M ink to the recording sheet 8. Thus, the thermal transfer printing cycle is repeated for all the color inks for printing.

When the pressure drum 7 carrying the recording sheet 8 and pressed against the intermediate transfer roller 1 is turned to transfer the ink dots 6 from the intermediate transfer roller 1 to the recording sheet 8, the pressure drum 7 must be separated temporarily from the intermediate transfer roller 1 every one full turn of the pressure drum 7, because gripper 9 collides with the intermediate transfer roller.

Therefore, the pressure drum 7 is separated from the intermediate transfer roller 1 to interrupt the recording operation temporarily upon the arrival of the gripper 9 at a separation position slightly before a collision position where the gripper 9 collides with the intermediate transfer roller 1. Then, the pressure drum 7 is turned through a circumferential distance corresponding to that through which the intermediate roller 1 is turned to form ink dots 6 on the intermediate roller 1 by the operation of the thermal print head 3. After the gripper 9 has passed the collision position, the ink dot forming operation for forming ink dots 6 on the intermediate transfer roller 1 is interrupted and the pressure drum 7 is pressed against the intermediate transfer roller 1 again to resume the ink dot transfer operation for transferring the ink dots 6 from the intermediate transfer roller 1 to the recording sheet 8.

Thus, the known thermal transfer printer needs to carry out troublesome operations to avoid the collision between the gripper 9 and the intermediate transfer roller 1, which reduces effective printing speed.

The thermal transfer printer needs additional mechanisms for separating the pressure drum 7 from the intermediate transfer roller 1 upon the arrival of the gripper 9 at the separation position and for rotating the pressure drum 7 at a surface speed equal to that of the intermediate transfer roller 1, which increases the dimensions and costs of the thermal transfer printer.

Furthermore, when there is even a slightest difference in circumferential movement between the intermediate transfer roller 1 and the pressure drum 7 while the operations for forming ink dots on the intermediate transfer roller 1 for starting and stopping ink dots from the intermediate transfer roller 1 to the recording sheet 8 are repeated, there occur troubles including the overlapping of ink dots on the recording sheet and the omission of ink dots on the recording sheet 8.

SUMMARY OF THE INVENTION

Accordingly, it is an object of the present invention to provide a thermal transfer printer having an intermediate transfer roller and a pressure drum provided with a gripper which will not collide with the intermediate transfer roller even when the pressure drum is not separated from the intermediate transfer roller, having a compact construction and capable of being manufactured at relatively low costs.

According to one aspect of the present invention, a thermal transfer printer comprises an intermediate transfer roller, and a pressure drum provided with grippers on its circumference and with end plates each having a cam section formed so as to come into contact with the circumference of the intermediate transfer roller when the pressure drum is pressed against the intermediate transfer roller and rotated and having a height from the circumference of the pressure drum greater than that of the upper ends of the grippers from the circumference of the pressure drum at its opposite ends, to avoid the collision of the grippers with the intermediate transfer roller. The collision of the grippers with the intermediate transfer roller can be avoided without separating the pressure drum from the intermediate transfer while the pressure drum is rotated to advance a recording sheet.

In the thermal transfer printer in accordance with the present invention, the grippers are placed on a flat surface formed by cutting a portion of the circumference of the pressure drum. When the grippers are thus placed on the flat surface, the collision of the grippers with the intermediate transfer roller can be avoided even when the lift of the cams of the end plates need not be very large and, consequently, load on a driving means for driving the pressure drum can be reduced.

In the thermal transfer printer in accordance with the present invention, the cam sections has a radially outward convex curved shape, and the length of the bases of the cam sections is greater than the distance between two edges between the circumference of the pressure drum and the flat surface formed by cutting a portion of the circumference of the pressure drum. When a recording sheet is transported by the pressure drum, the recording sheet does not come into contact with the edges and hence the recording sheet is neither damaged nor folded by the edges.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
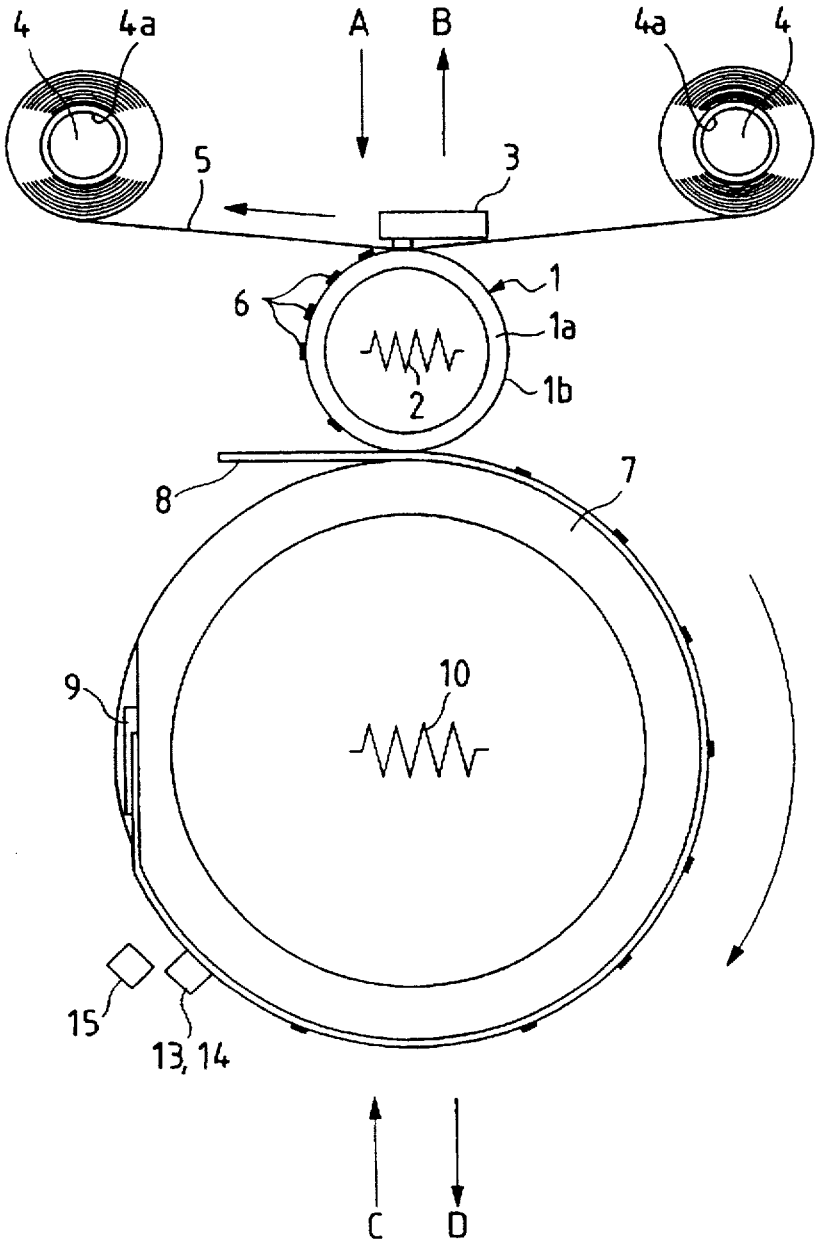
FIG. 1 is a sectional view of an essential portion of a thermal transfer printer in a first embodiment according to the present invention.

Referring to FIG. 1 showing an essential portion of a thermal transfer printer in a first embodiment according to the present invention, a cylindrical intermediate transfer roller 1 is supported for rotation, and has a heater 2 for heating the intermediate transfer roller 1 at a predetermined temperature is disposed inside the intermediate transfer roller 1. The intermediate transfer roller 1 is formed by coating the circumference of a core cylinder 1*a* with an elastic coat 1*b* of a silicone rubber, and coating the circumference of the elastic coat 1*b* with a transfer film, not shown. The intermediate transfer roller 1 serves as a platen roller. A driving device, not shown, such as a motor, is operatively connected to the intermediate transfer roller 1.

Desirably the outside diameter of the intermediate transfer roller 1 is 20 mm or above in view or securing a sufficient bending rigidity. However, the outside diameter of the intermediate transfer roller may be less than 20 mm when the core cylinder 1*a* is highly rigid. In this embodiment, the core cylinder made of a carbon steel, is 31 mm in outside diameter and 28 mm in inside diameter, and the circumference of the intermediate transfer roller 1 is nickel-plated. The elastic coat 1*b* coating the circumference of the core cylinder 1*a* is 0.5 mm in thickness, and the transfer film coating the circumference of the elastic coat 1*b* is made of a silicon rubber of a quality different from that of the silicone rubber forming the elastic coat 1*b* and has a thickness 150 μm.

In this embodiment the heater 2 is a 500 W halogen lamp. However, the heater 2 may be of any suitable type, such as a cartridge heater. Provided that the heater 2 is capable of generating heat energy sufficient to keep ink dots transferred from an ink ribbon 5 to the circumference of the intermediate transfer roller 1 in a molten or softened state.

A thermal print head 3 is disposed near the intermediate transfer roller 1. The thermal print head 3 is a 200 to 600 dpi line print head having a plurality of heating elements arranged in a line and a width in the rang of 75 to 300 mm. In this embodiment, the thermal print head 3 is a 300 dpi line print head of 220 mm in width having 2560 heating elements. A lair of ribbon rolls 4*a* are disposed on the transversely opposite sides of the thermal print head 3, respectively, to support an ink ribbon 5 which is wound around bobbins 4 and to extend the ink ribbon 5 substantially linearly through a space between the intermediate transfer roller 1 and the thermal print head 3. The ink ribbon 5 is an ordinary ink ribbon used generally for thermal transfer printing. In this embodiment, the ink ribbon 5 has a 3.5 μm thick base film of PET (polyethylene terephthalate), a 1 μm thick separating layer of wax formed on the base film, and a 1 μm thick ink layer of a resin formed over the separating layer.

A pressure drum 7, i.e., a recording medium holding device, is supported for rotation and pressed by a high pressure against a portion of the circumference of the intermediate transfer roller 1 diametrically opposite a portion of the same corresponding to the heating elements of the thermal print head 3.

The pressure drum 7 has a circumference long enough to wrap a recording sheet 8, i.e. a recording medium, around the pressure drum 7. A pair of grippers 9 having the shape of a flat plate for clamping and firmly holding on the pressure drum 7 one end of the recording sheet 8 are disposed so as to extend in parallel to the axis of the pressure drum 7. The thermal transfer printer in this embodiment is designed to print A4-size and letter-size recording sheets. Therefore, the pressure drum 7 has an outside diameter of 100 mm to secure a circumferential length necessary for supporting the recording sheet 8 of about 300 mm in length and for securing a space of about 14 mm for the grippers 9.

Figure 2:
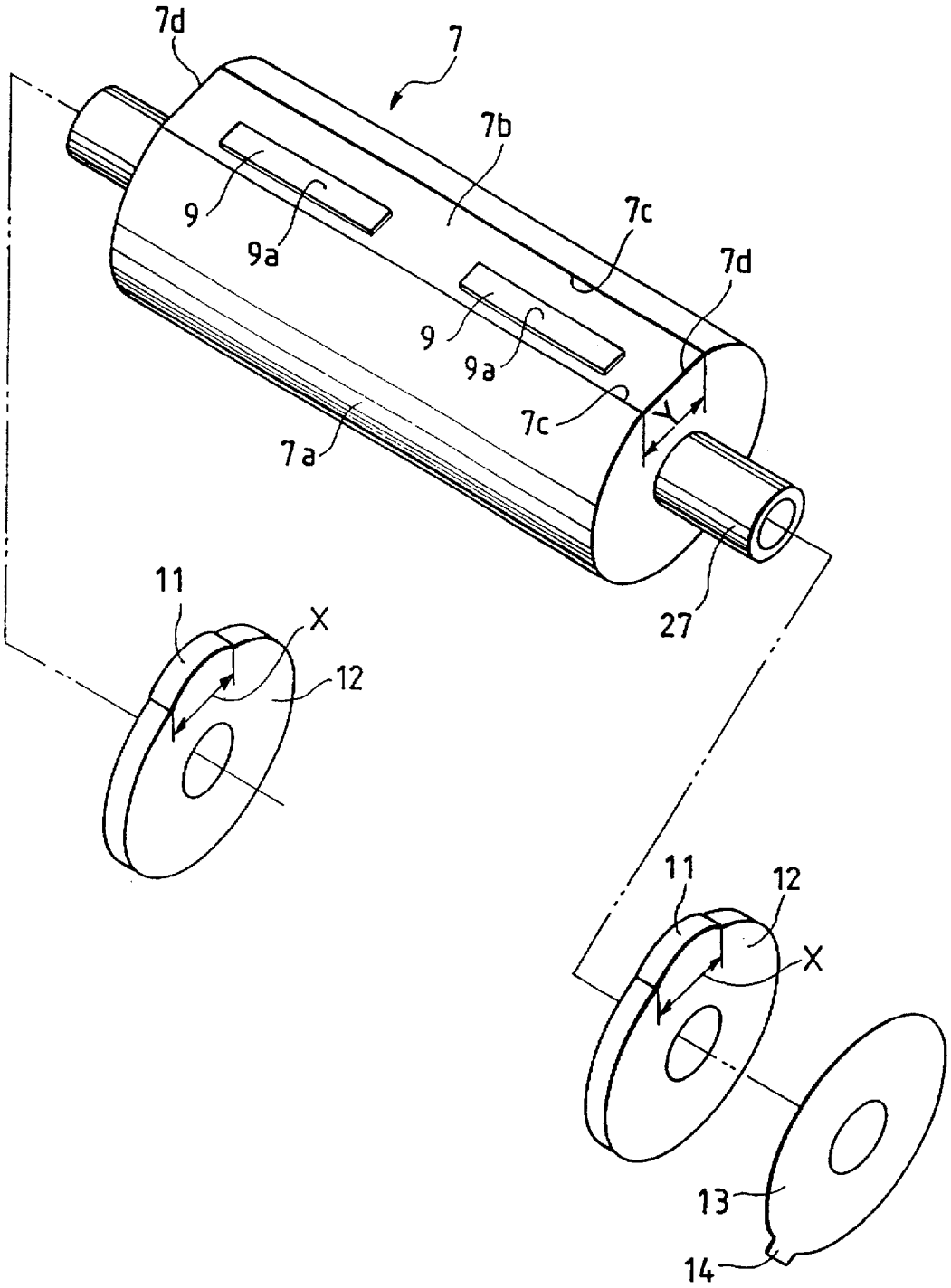
FIG. 2 is an exploded perspective view of a pressure drum provided with grippers, included in thermal transfer printer of FIG. 1.

Referring to FIG. 2, a section of t he outer circumference 7*a* of the pressure drum 7 is cut flat to form a flat surface 7*b* (D-cut surface) for disposing the grippers 9. The flat surface 7*b* is formed so that the upper ends 9*a* of the grippers 9 set on the flat surface 7*b* are radially inside the outer circumference 7*a* of the pressure drum 7. The grippers 9 are opened and closed by a gripper driving mechanism, not shown, to clamp and release the recording sheet.

Figure 3:
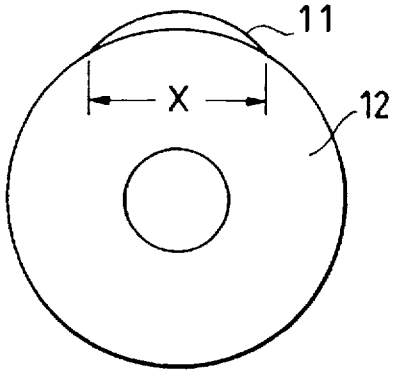
FIG. 3 is a front view of a flange included in the thermal transfer printer of FIG. 1.

Referring to FIG. 3, the pressure drum 7 is provided on its opposite ends with end plates 12 each having a cam section 11. The end plates 12 are fastened to the pressure drum 7 by suitable fastening means, such as screws, so that the cam sections 11 coincide with the opposite longitudinal ends 7*d* of the flat surface 7*b* on which the grippers 9 are set. The cam sections 11 protrude from the level of the upper ends 9*a* of the grippers 9 to prevent the collision of the grippers 9 with the intermediate transfer roller 1; that is, the cam sections 11 are formed so that the grippers 9 may not come into contact with the elastic coat 1*b* of the intermediate transfer roller 1. In this embodiment, the lift of the cam sections 11 is 1.5 mm. Although the greater the lift of the cam sections 11 the greater the effect of the cam sections 11 in preventing the collision of the grippers 9 with the intermediate transfer roller 1, a nigh driving force for driving the pressure drum 7 is necessary to move the cam sections 11 past the intermediate transfer roller 1. Therefore, it is desirable that the cam sections 1 have the least necessary lift.

Figure 4:
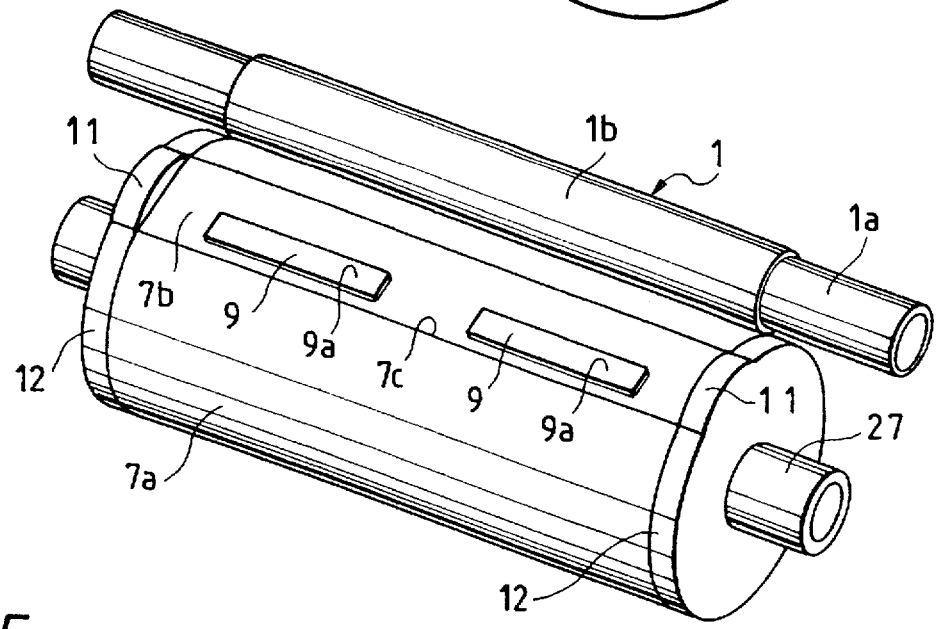
FIG. 4 is perspective view showing the positional relation between the flanges and an intermediate transfer roller in the thermal transfer printer of FIG. 1.
Figure 5:
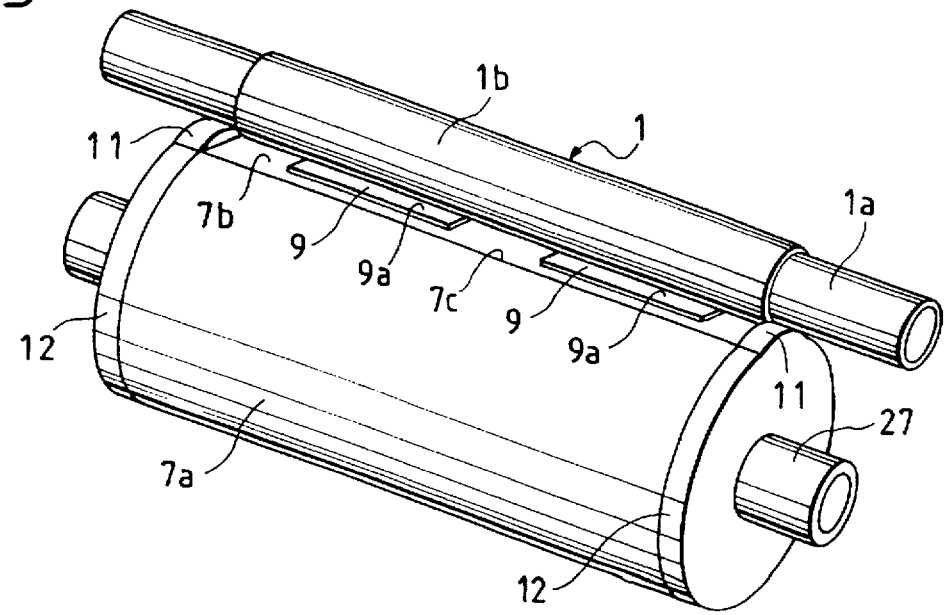
FIG. 5 is a perspective view showing the positional relation between the flanges and the intermediate transfer roller in the thermal transfer printer of FIG. 1.

The diameter of the end plates 12 is slightly smaller than the outside diameter of the pressure drum 7 to prevent the end plates 12 from coming into contact with the elastic coat 1b when the pressure drum 7 is pressed against the intermediate transfer roller 1 and the elastic coat 1*b* is deformed elastically. Besides, the dimensions of the pressure drum 7 and the end plates 12 are determined so that the end plates 12 are in contact with the portions of the core cylinder la contiguous with the opposite longitudinal ends of the elastic coat 1*b* as shown in FIGS. 4 and 5.

As mentioned above, the grippers 9 are set on the flat surface 7*b* formed by cutting a portion of the pressure drum 7. However, the grippers 9 may be set on the outer circumference of the pressure drum 7, and the cam section 11 may be formed so as to protrude from the level of the upper ends 9*a* of the grippers 9 to prevent the collision of the grippers 9 with the intermediate transfer roller 1. However, when the cam sections 11 are thus formed, the pressure drum 7 requires a large torque for turning the cam sections 11 past the core cylinder 1*a* of the intermediate transfer roller 1 and hence the thermal transfer printer needs a motor of a high output capacity, whereby the cost of the thermal transfer printer is increased. Therefore, it is preferable to set the grippers 9 on the flat surface 7*b* of the pressure drum 7.

As shown in FIGS. 2 and 3, the length X of the bases of the radially outwardly convex cam sections 11 is greater than the width Y of the flat surface 7*b*, ie., the distance between two edges 7*c* between the circumference of the pressure drum 7 and the flat surface 7*b*. Therefore, the recording sheet 8 does not come into contact with the edges 7*c* and hence the recording sheet 8 is neither damaged nor folded by the edges 7*c* when the pressure drum 7 rotates.

A disk-shaped index plate 13 having a radial, rectangular projection 14 is attached to one of the end plates 12. A sensor 15 (FIG. 1) for detecting the projection 14 is held fixedly on a fixed part, not shown, of the thermal transfer printer, such as a housing covering the components of the thermal transfer printer, a case containing the pressure drum 7 or a frame supporting the pressure drum 7. The sensor 15 provides a signal upon the detection of the projection 14 and the angular position of a print starting position on the recording sheet 8 is determined from the signal provided by the sensor 15.

A heater 10 for heating the pressure drum 7 at a predetermined temperature is disposed inside the pressure drum 7. In this embodiment, the heater 10 is a 1 kW halogen lamp. The heater 10 may be of any type provided that the heater 10 is capable of generating thermal energy sufficient for keeping the recording sheet 8 wrapped around the pressure drum 7 warm to enhance the ability of ink dots to transfer from the intermediate transfer roller 1 to the recording sheet 8. The recording sheet 8 may be either an ordinary plain recording sheet or a film for OHP.

Figure 6:
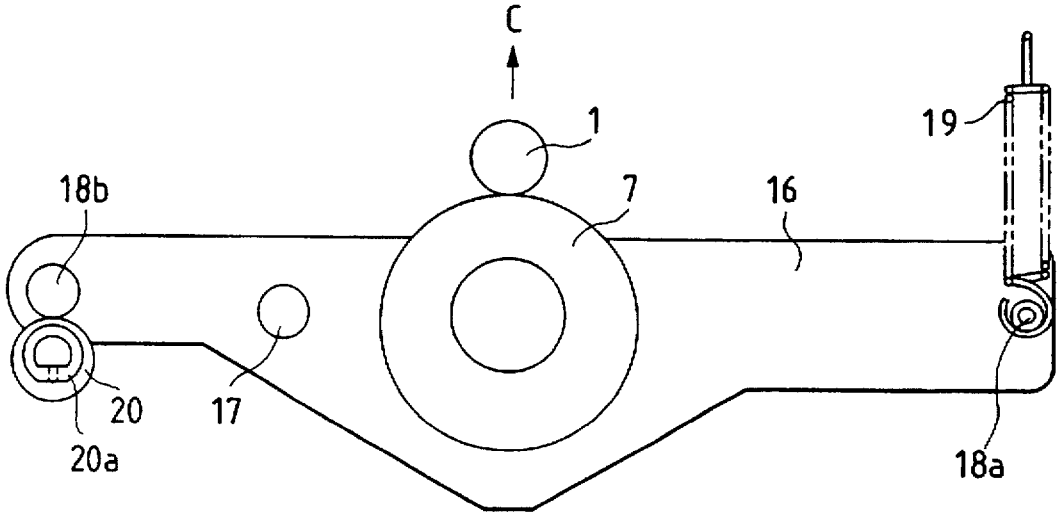
FIG. 6 is a front view of a pressure drum pressing mechanism included in the thermal transfer printer of FIG. 1.
Figure 7:
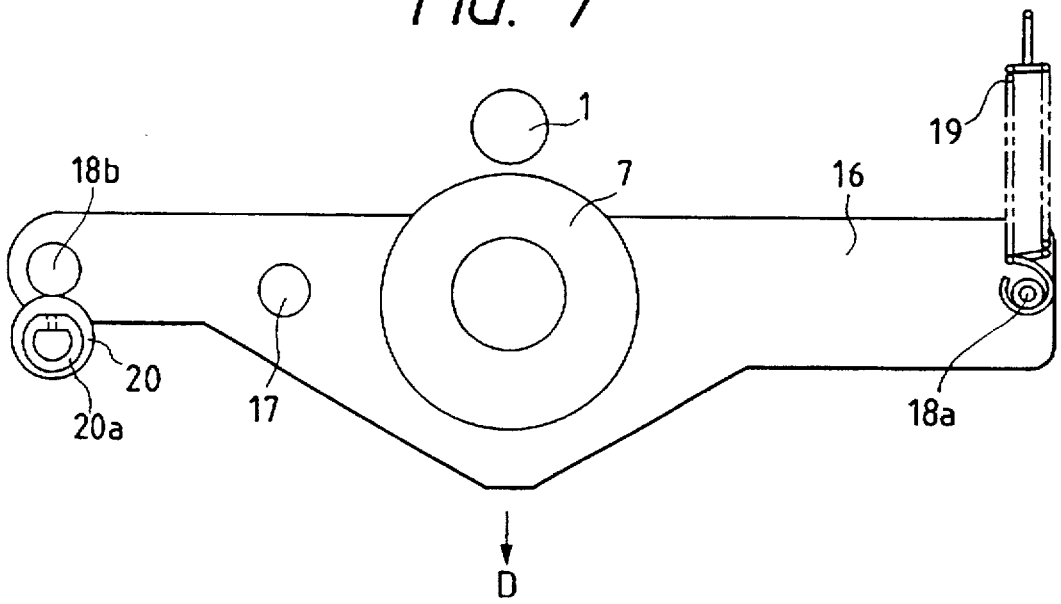
FIG. 7 is a front view of the pressure drum pressing mechanism of FIG. 6.

A pressure drum pressing mechanism for pressing the pressure drum 7 against the intermediate transfer roller 1 will be described hereinafter. Referring to FIGS. 6 and 7, a shaft 27 supporting the pressure drum 7 is supported at its opposite end portions on a drum support frame 16. The drum support frame 16 has a point of action corresponding to the shaft 27, a first point 18*a*, a second point 18 and a supporting point 17. The first point 18*a* is at one end of the drum support frame 16, and a spring 19 for exerting a force to press the pressure drum 7 against the intermediate transfer roller 1 on the drum support frame 16 is connected to the point 18*a*. The second point 18*b* is at the other end of the drum support frame 16, and an eccentric plate cam 20 supported on a shaft 20*a* driven by a stepping motor, not shown, is in contact with the second point 18*b*.

When pressing the pressure drum 7 against the intermediate transfer roller 1, the spring 19 pulls the point 18*a* of the drum support frame 16 to remove the pressure drum 7 in the direction of the arrow C (FIG. 6). When separating the pressure drum 7 from the intermediate transfer roller 1, the shaft 20*a* of the eccentric plate cam 20 is turned so as to raise the second point 18*b*, so that the drum support frame 16 is turned on the supporting point 17, the first point 18*a* is lowered against the force of the spring 19 and the pressure drum 7 is moved in the direction of the arrow D (FIG. 7).

The pressure drum 7 is pressed against the intermediate transfer roller 1 by a pressure in the range of 1 to 10 kg/cm$^2$. In this embodiment, the pressure is 5 kg/cm$_2$.

The printing operation of the thermal transfer printer will be described hereinafter. In an initial state, the thermal print head 3 is rated from the intermediate transfer roller 1 and the ink ribbon 5 by moving the same the direction of the arrow B (FIG. 1) and held at a standby position and the pressure drum 7 is separated from the intermediate transfer roller 1 by moving the same in the direction of the arrow D (FIG. 1) and held at a standby position.

When the thermal transfer printer is connected to a power source, the heaters 2 and 10 are energized to start heating the intermediate transfer roller 1 and pressure drum 7, and a pulse current is supplied to the thermal print head 3 to warm up the thermal print head 3. The intermediate transfer roller 1, the thermal print head 3 and the pressure drum 7 are heated to predetermined temperatures, respectively.

The respective temperatures of (the intermediate transfer roller 1, the thermal print head 3 and the pressure drum 7 are monitored by thermistors or infrared thermometers and a temperature control operation is executed to heat and keep the intermediate transfer roller 1, the thermal print head 3 and the pressure drum 7 at equal predetermined temperatures in the range of 40° to 70° C. preferably in the range of 50° to 60° C. In this embodiment, the temperatures are controlled so as to vary in the range of 55° to 58° C.

An operation for wrapping the recoding sheet 8 around the pressure drum 7 is carried out simultaneously with the foregoing temperature control operation. Recording sheet 8 contained in a Sheet feed tray are fed one at a time to pressure drum 7. After the grippers 9 have clamped the leading edge of the recording sheet 8, the pressure drum 7 is turned for an initial recording sheet positioning operation so that the recording sheet 8 is wrapped around the pressure drum 7 and the recording sheet is positioned at an initial printing position.

During the initial recording sheet positioning operation, the pressure drum 7 is driven frictionally by the intermediate transfer roller instead of by a pressure drum driving mechanism. The pressure drum 7 is moved in the direction of the arrow C (FIG. 6) by pulling the point 18*a* by the spring 19 to press the pressure drum 7 against the intermediate transfer roller 1, and then the intermediate transfer roller 1 is rotated by an intermediate transfer roller driving mechanism, not shown, whereby the pressure drum 7 is driven frictionally for rotation by the intermediate transfer roller 1.

When the print starting position of the recording sheet 8 is positioned at a printing position corresponding to the thermal print head 3, the protection 14 of the index plate 13 coincides with the sensor 15. Upon the detection of the projection 14, the sensor provides a signal to stop the intermediate transfer roller 1, so that the pressure drum 7 is stopped.

Meanwhile, the ink ribbon 5 is fed to set the leading edge of a desired color section of the ink ribbon at the printing position.

The ink ribbon 5 employed in this embodiment is a four-color ink ribbon having a repetitive arrangement of a color segments each consisting or a Y ink section, a M ink section, a C ink section and a Bk ink section arranged in that order. Y ink dots, M ink dots, C ink dots and Bk ink dots are printed in that order. Therefore, the ink ribbon 5 is fed for color section positioning so that the leading edge of the Y ink section is set first at the printing position corresponding to the thermal print head 3. The Y ink sections, the M ink sections, the C ink sections and the Bk ink sections are identified by markers printed on boundaries between the contiguous ink sections by a sensor, not shown, such as a photosensor.

When the ink ribbon 5 is a monochromatic ink ribbon, color section identification is necessary and hence the ink ribbon 5 need not be fed for color section positioning. However, the ink ribbon 5 may be fed beforehand to take up the slack in the ink ribbon 5.

Upon the arrival of the leading edge of the Y ink section at the printing position corresponding to the thermal print head 3, the thermal print head 3 is shifted in the direction of the arrow A (FIG. 1) to press the thermal print head 3 through the ink ribbon 5 against the intermediate transfer roller 1. The heating elements of the thermal print head 3 are energized selectively to melt and transfer portions of the Y ink section to the intermediate transfer roller 1 to form Y ink dots 6 on the intermediate transfer roller 1. Since the intermediate transfer roller 1 is heated by the heater 2, the Y ink dots 6 remain in a molten or softened state while the intermediate transfer roller 1 is rotating. Then, the Y ink dots 6 are transferred from the intermediate transfer roller 1 to the recording sheet 8 wrapped around the pressure roller 7, pressed against the intermediate transfer roller 1 and heated by the heater 10 built in the pressure drum 7.

Although the grippers 9 are positioned near the print starting position of the recording sheet 8, the grippers 9 do not collide against the intermediate transfer roller 1, because the cam sections 11 of the end plates 12 attached to the opposite ends of the pressure drum 7 come into contact with the core cylinder 1*a* of the intermediate transfer roller 1 and, consequently, the pressure drum 7 is moved away from the intermediate transfer roller the direction of the arrow D (FIG. 1).

The pressure drum 7 pressed against the intermediate transfer roller 1 is driven frictionally by the intermediate transfer roller 1. When the grippers 9 approach the intermediate transfer roller 1, the cam sections 11 of the end plates 12 come into contact with the core cylinder 1*a* of the intermediate transfer roller 1 to move the pressure drum 7 away from the intermediate transfer roller 1 the direction of the arrow D while the pressure drum 7 is being continuously driven for rotation by the intermediate transfer roller 1. The cam sections 11 of the end plates 12 pass the intermediate transfer roller 1 simultaneously with the passage of the grippers 9 by the intermediate transfer roller 1, and then the pressure drum 7 comes again into contact With the intermediate transfer roller 1 for continuous rotation.

Since the diameter of the end plates 12 excluding the cam sections 11 is slightly smaller than that of the pressure drum 7, the end plates 12 do not come into contact with the intermediate transfer roller 1 even if the elastic coat 1*b* of the intermediate transfer roller 1 is compressed by the pressure applied thereto by the pressure drum 7 and hence an appropriate transfer pressure can be secured.

After a thermal transfer printing cycle for printing the Y ink dots 6 on the recording sheet 8 has been completed, a thermal transfer printing cycle or printing M ink dots 6 to the recording sheet 8 is started without separating the thermal print head 3 and the pressure drum 7 from the intermediate transfer roller 1.

The length of the color sections of the ink ribbon is determined so that the leading edge of the succeeding color section is positioned automatically at the printing position corresponding to the thermal print head 3 upon the completion of a thermal transfer printing cycle for printing the ink dots of the preceding color section. Therefore, the thermal print head 3 and the pressure drum 7 need not be separated from the intermediate transfer roller 1 and the ink ribbon 5 need not be fed for positioning the leading edge of the M ink section at the printing position after the completion of the Y ink dot printing operation. Thus, the thermal transfer printing cycle can continuously be repeated to print color ink dots of the four colors of the four color sections on the recording sheet 8.

Upon the completion of printing the Y, M, C and Bk ink dots 6 on the recording sheet 8, the thermal print head 3 is moved away from the intermediate transfer roller 1 in the direction of the arrow B and the pressure drum 7 is moved away from the intermediate transfer roller 1 in the direction of the arrow D to separate the thermal print head 3 and the pressure drum 7 from the intermediate transfer roller 1, and then the grippers 9 releases the recording sheet 8 and the recording sheet is delivered from the thermal transfer printer.

Figure 8:
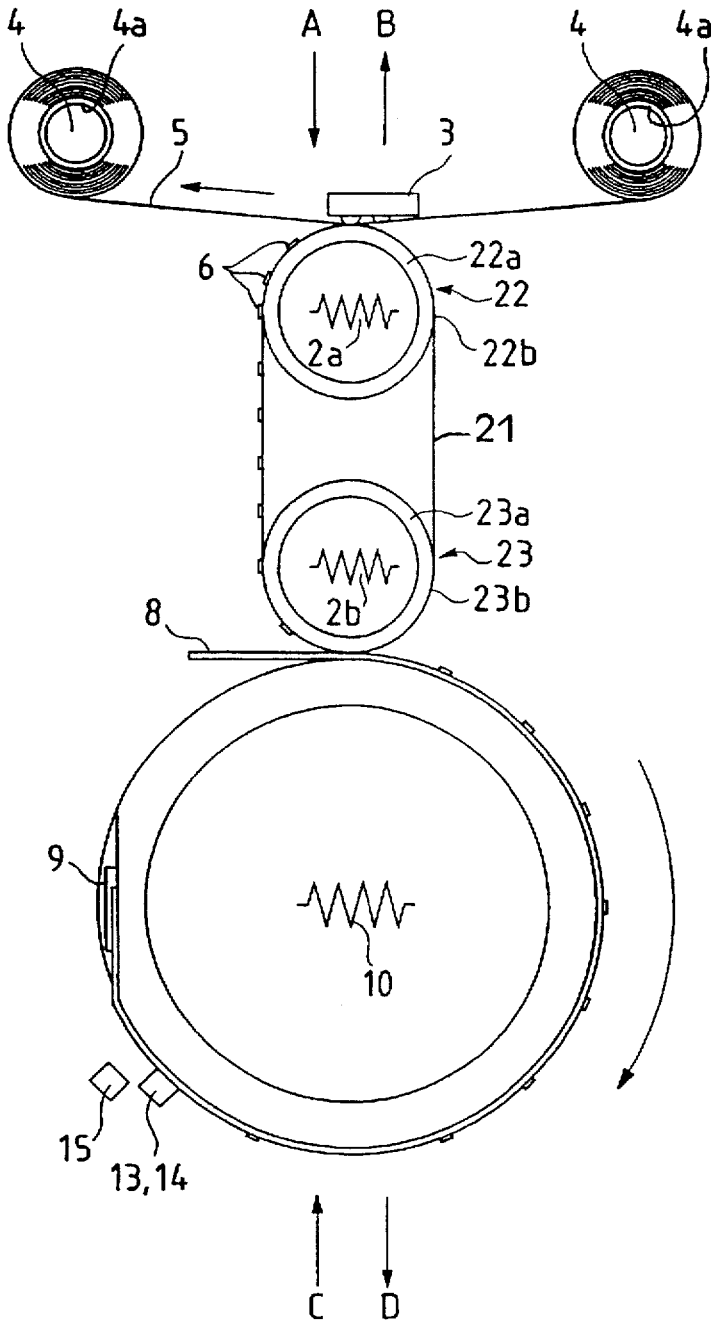
FIG. 8 is a sectional view of an essential portion of a thermal transfer printer in a second embodiment according to the present invention.

A thermal transfer printer in a second embodiment will be described hereinafter with reference to FIG. 8, in which parts like or corresponding to those of the foregoing thermal transfer printer in the first embodiment are designated by the same reference characters and the description thereof will be omitted.

The thermal transfer printer in the second embodiment employs an intermediate transfer belt 21 instead of the intermediate transfer roller 1. The intermediate transfer belt 21 is extended taut For turning between a platen roller 22 and a pressure roller 23.

Although the intermediate transfer belt 21 is of a seamless type, the intermediate transfer belt 21 may have a seam when a portion of the intermediate transfer belt 21 around the seam is not used for ink dot transfer. In this embodiment, the intermediate transfer belt 21 is a 50 μm thick polyimide seamless belt coated with a 150 μm thick rubber layer.

The platen roller 22 and the pressure roller 23 have independent functions, respectively. The platen roller 22 operates to support the intermediate transfer belt 21 when forming ink dots 6 on the intermediate transfer belt 21. The pressure roller 23 supports the intermediate transfer belt 21 when transferring the ink dots 6 from the intermediate transfer belt 21 to a recording sheet 8. The platen roller 22 is formed by coating an aluminum alloy core cylinder **22*a* of 16 mm in diameter with a 1 mm thick elastic layer 22*b* of a silicone rubber. A heater 2*a* is disposed inside the platen roller 22 to control the surface temperature of the intermediate transfer belt 21 at 40° C. In this embodiment, the heater 2*a*** is a 200 W halogen lamp.

The pressure roller 23 is formed by coating an aluminum alloy core cylinder **23*a* of 42 mm in diameter with a 0.5 mm thick elastic layer 23*b* of a silicone rubber. A heater 2*b* is disposed inside the pressure roller 23 to control the surface temperature of the intermediate transfer belt 21 at 65° C. In this embodiment, the heater 2*b*** is a 200 W halogen lamp.

Since the ink dots are formed on the intermediate transfer belt 21 at a position corresponding to the platen roller 22, and the ink dots are transferred from the intermediate transfer belt 21 to the recording sheet 8 at a position corresponding to the pressure roller 23, optimum conditions for thermal transfer printing can be determined.

Although the present invention has been described as applied to the thermal transfer printer for printing only one accordance with the present invention is able to print both sides Of recording sheets 8 by repeating the foregoing thermal transfer printing cycle.

Recording sheet conveying means for conveying recording sheets 8 to print both sides of the recording sheets 8 will be described with reference to FIGS. 9 to 11.

Figure 9:
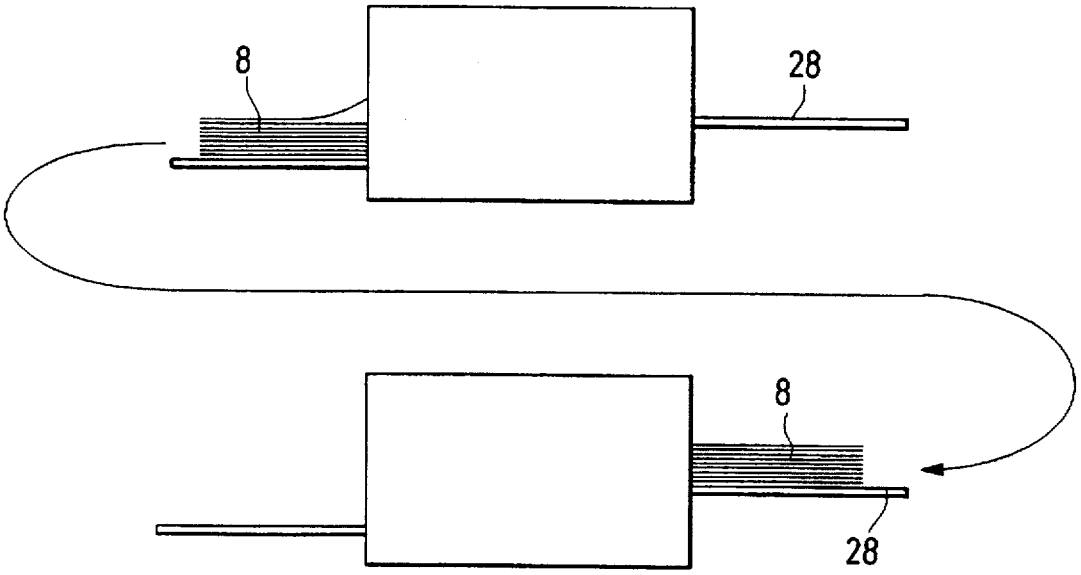
FIG. 9 is a schematic front view of a thermal transfer printer in accordance with the present invention, for assistance in explaining recording sheet conveying means for conveying recording sheets to print both sides of the recording sheets.

FIG. 9 shows a first recording sheet conveying means for conveying recording sheets 8 to print both sides of the recording sheets 8.

When the first recording sheet conveying means is used, recording sheets having one side printed by the thermal transfer printer and delivered from the thermal transfer printer in a first thermal transfer printing cycle are returned to and stacked in a sheet feed tray 28 by the operator so that the other side of the recording sheets 8 are printed in a second thermal transfer printing cycle.

Figure 10:
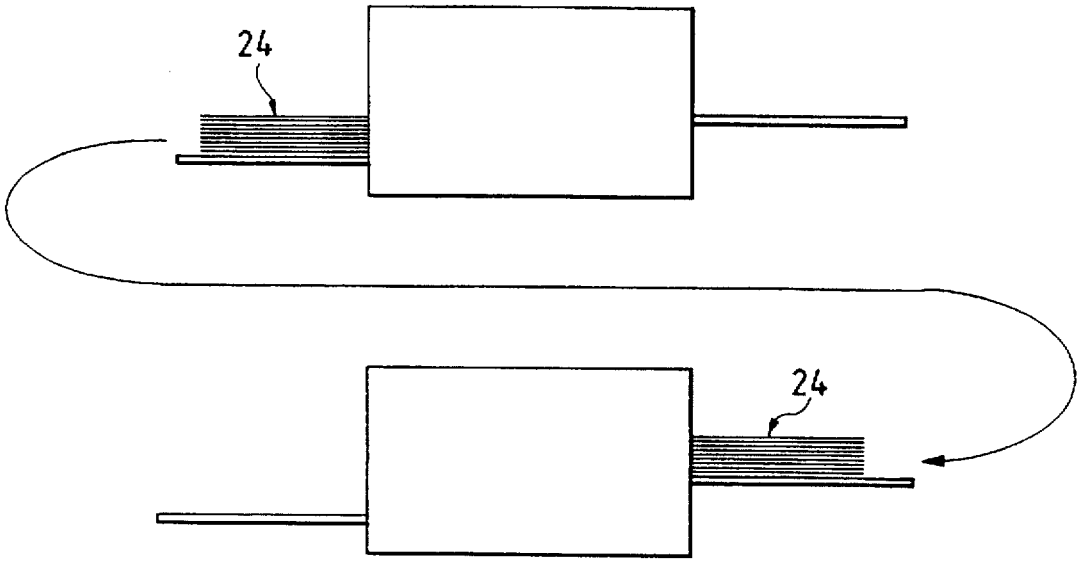
FIG. 10 is a schematic front view of a thermal transfer printer in accordance with the present invention, for assistance in explaining a second recording sheet conveying means for conveying recording sheet to print both sides of the recording sheets.

A second recording sheet conveying means shown in FIG. 10 is the same in principle as the first recording sheet conveying means. The second recording sheet conveying means simplifies the operators manual work.

The second recording sheet conveying means employs a printed recording sheet storage tray 24 which can be used also as a sheet feed tray. Recording sheets 8 having one side printed by the thermal transfer printer and delivered from the thermal transfer printer are stacked in the printed recording sheet storage tray 24, the printed recording sheet storage tray 24 containing the recording sheets 8 is set upside down at the recording sheet feed position, and then the recording sheet 8 are fed again into the thermal transfer printer to the other side of the recording sheets 8.

Figure 11:
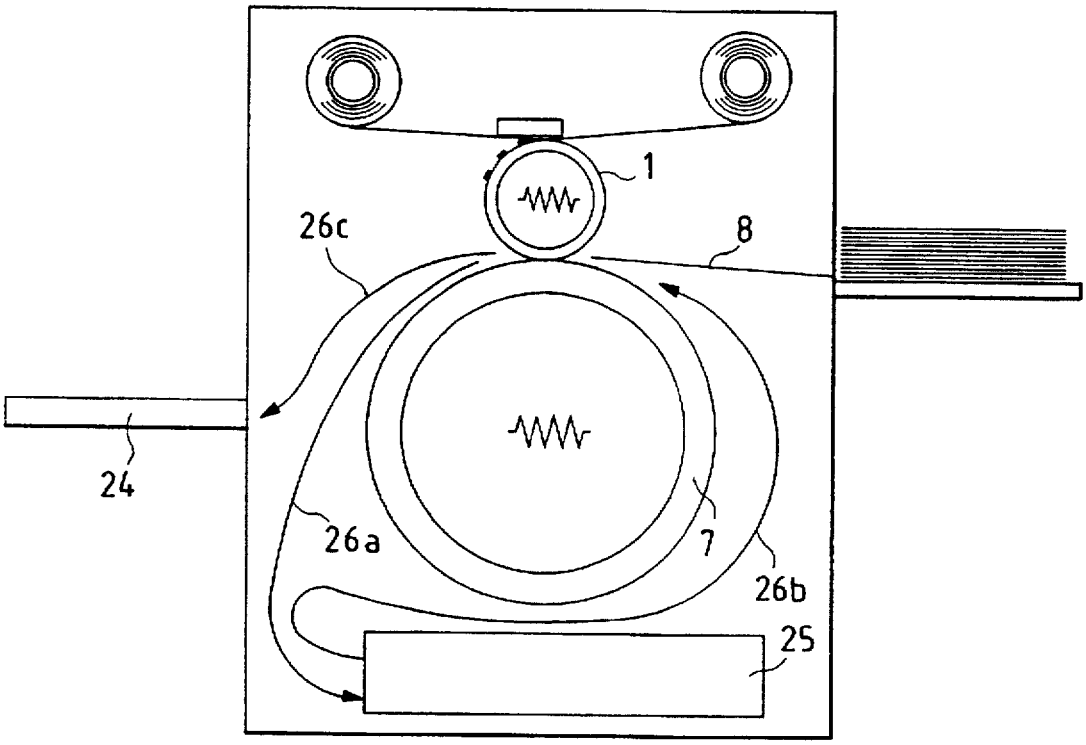
FIG. 11 is a schematic sectional view of a thermal transfer printer in accordance with the present invention, for assistance in explaining a third recording sheet conveying means for conveying recording sheet to print both sides of the recording sheets.
Figure 12:
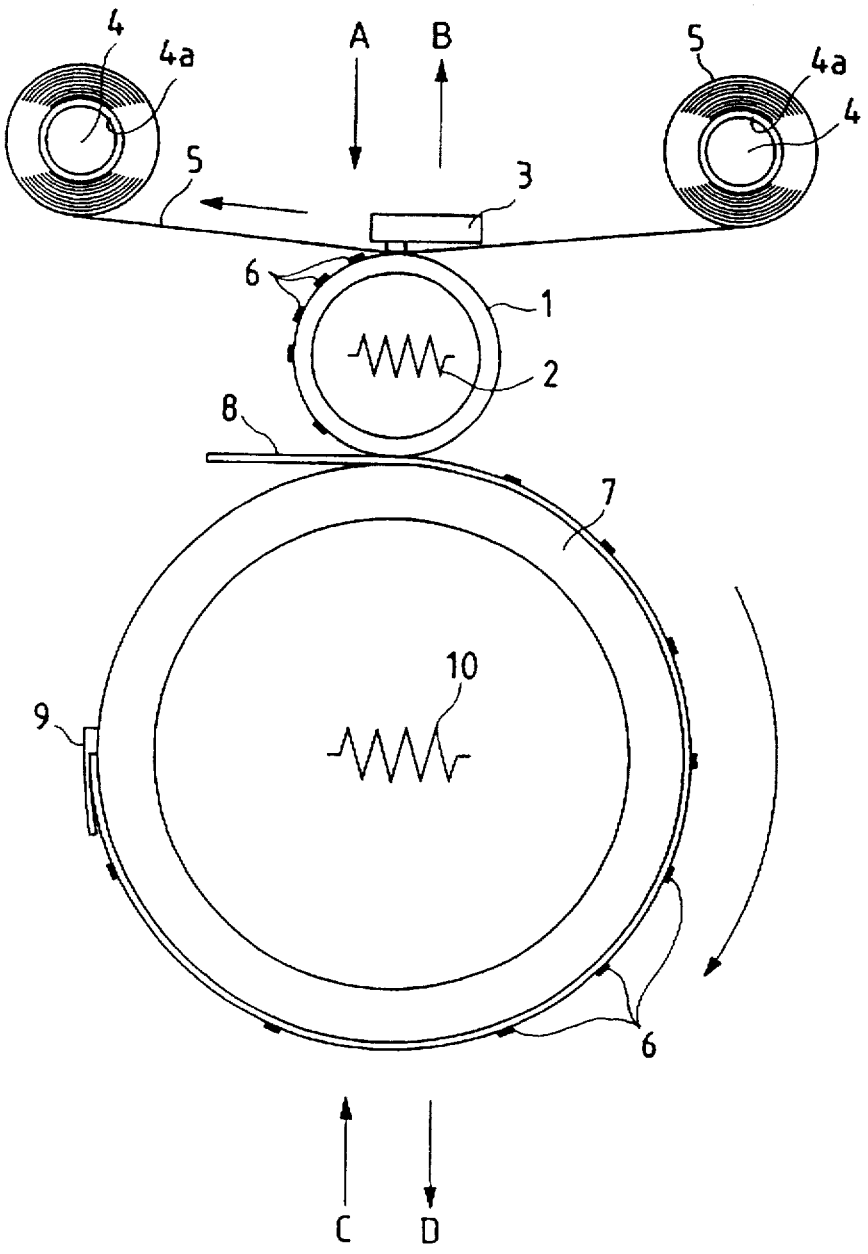
FIG. 12 PRIOR ART
FIG. 12 is a sectional view of an essential portion of a conventional thermal transfer printer.
Figure 13:
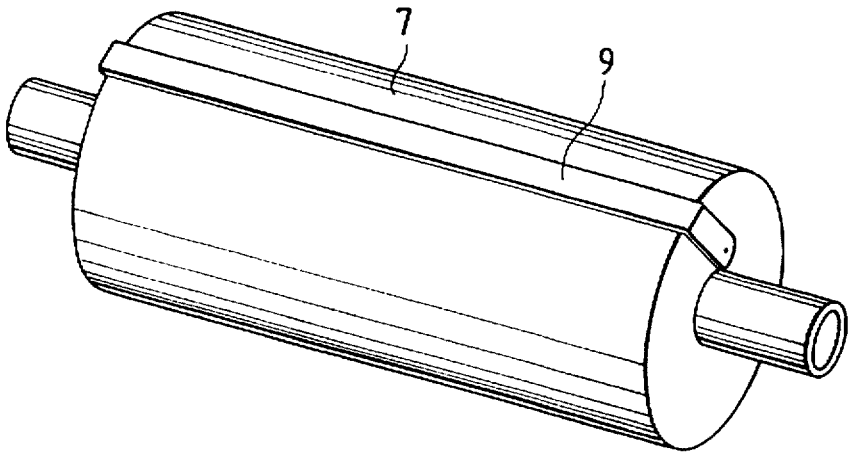
FIG. 13 PRIOR ART
FIG. 13 is a perspective view of a pressure drum provided with a gripper and included in the thermal transfer printer of FIG. 12.

A third recording sheet conveying means shown in FIG. 11 conveys recording sheets 8 to be printed on both sides within the thermal transfer printer Recording sheets 8 printed on their one side is delivered through a first sheet conveying route **26*a* to and stored temporarily in a storage tray 25, the recording sheets 8 are conveyed from the storage tray 25, through a second sheet conveying route 26*b* to the printing position so that the other side thereof can be printed, and then the recording sheets 8 printed on their both sides are delivered through a third sheet conveying route 26*c* to the Sheet storage tray 24**.

As is apparent from the foregoing description, according to the present invention, the grippers 9 do not collide with the intermediate transfer roller 1 even through the pressure drum 7 is not separated from the intermediate transfer roller 1 because the cam sections 11 of the end plates 12 protrude from the level of the upper ends of the grippers 9. Consequently, the thermal transfer printer is able to operate at an increased printing speed, and can be formed in a compact construction and be manufactured at a relatively low cost.

Since the grippers 9 are placed on the flat surface **7*b* formed by cutting a portion of the pressure drum 7, the effective lift of the cam sections 11 may be very small and hence the driving force of the driving means necessary to move the cam sections 11 past the intermediate transfer roller 1** may be low. Consequently the driving mechanism including a motor can be formed in a compact construction and can be manufactured at a relatively low cost.

Since the length X of the bases of the radially outwardly convex cam sections 11 is greater than the width Y of the flat surface 7b, i.e., the distance between two edges 7c between the circumference 7a of pressure drum 7 and the flat surface 7b, the recording sheet 8 does not come into contact with the edges 7c and hence the recording sheet 8 is neither damaged nor folded by the edges 7c when the pressure drum 7 rotates.

When necessary the thermal print head 3 and the pressure drum 7 may be separated from the intermediate transfer roller 1 every time a thermal transfer printing cycle for printing ink dots of the color of the preceding ink section of the four-color ink segment of the ink ribbon 5 to detect the leading edge of the succeeding color section of the same four-color ink segment.

When a monochromatic ink ribbon is used the recording sheet 8 is released from the grippers 9 upon the completion of thermal transfer printing cycle and the printed recording sheet 8 is delivered to the delivery tray 24.

Although the invention has been described in its preferred form with a certain degree of particularity obviously many changes and variations are possible therein. It is therefore to be understood that the present invention may be practiced otherwise than as specifically described herein without departing from the scope and spirit thereof.

What is claimed:

1. A thermal transfer printer having an intermediate transfer member comprising:

the intermediate transfer member;

a thermal print head for transferring portions of an ink layer from an ink ribbon to a circumferential surface of said intermediate transfer member in ink dots; and a pressure drum to be pressed against said intermediate transfer member to transfer the ink dots from said intermediate transfer member thereto, provided with grippers coupled to a circumferential surface of the pressure drum and with end plates each having a circumferential section and a cam section, the circumferential section having a circumference less than a circumference of said pressure drum, the cam section formed so as to come into contact with the circumferential surface of said intermediate transfer member when said pressure drum is pressed against said intermediate transfer member and rotated and having a height from the circumferential surface of said pressure drum greater than that of upper ends of the grippers from the circumferential surface of said pressure drum at its opposite ends to avoid the collision of the grippers with said intermediate transfer member.

2. The thermal transfer printer according to claim 1, wherein the grippers are placed on a flat surface formed by cutting a portion of the circumferential surface of said pressure drum.

3. The thermal transfer printer according to claim 2, wherein the cam sections have a radially outward convex curved shape, and the length of the bases of the cam sections is greater than the distance between two edges between the circumferential surface of said pressure drum and the flat surface formed by cutting a portion of the circumferential surface of said pressure drum.

4. The thermal transfer printer according to claim 1, wherein said intermediate transfer member comprises an intermediate transfer roller.

5. A thermal transfer printer comprising:

an intermediate transfer member including two end circumferential surfaces and an intermediate circumferential surface located between the end circumferential surfaces, the intermediate circumferential surface having a circumference greater than circumferences of the end circumferential surfaces;

a thermal print head for transferring ink from an ink carrying device to the intermediate circumferential surface of said intermediate transfer member;

a pressure drum including a circumferential surface and a gripper, the gripper including lower and upper portions, the lower portion being coupled to the surface of said pressure drum, wherein when the gripper grips a recording medium and said pressure drum rotates, said pressure drum presses the recording medium against said intermediate transfer member to transfer ink from said intermediate transfer member to the recording medium;

end plates, each of said end plates having a cam section formed so as to come into contact with each of the end circumferential surfaces of said intermediate transfer member when said pressure drum is pressed against said intermediate transfer member and rotated, each cam section having a height from the surface of said pressure drum greater than a height of the upper portion of the gripper from the surface of said pressure drum to prevent contact of said intermediate transfer member with the gripper.

6. The thermal transfer printer according to claim 5, wherein said intermediate transfer member comprises an intermediate transfer roller.

7. The thermal transfer printer according to claim 5, wherein said intermediate transfer member comprises:

a platen roller;

a pressure roller; and an intermediate transfer belt extended between said platen roller and said pressure roller, said platen roller supporting said intermediate transfer belt proximate to said thermal print head for transferring ink from the ink carrying device to said intermediate transfer belt, said pressure roller supporting said intermediate transfer belt proximate to said pressure drum for transferring the ink from said intermediate transfer belt to the recording medium when the recording medium is gripped by the gripper.

8. The thermal transfer printer according to claim 5, further comprising the ink carrying device, said ink carrying device comprising:

first and second ink bobbins; and an ink ribbon disposed for transfer from said first ink bobbin to said second ink bobbin between said intermediate transfer member and said thermal print head.

9. The thermal transfer printer according to claim 5, wherein the surface of said pressure drum includes a flat surface for mounting the gripper, the flat surface being formed by cutting a portion of the circumference of said pressure drum; and the cam sections of said end plates are positioned proximate to the flat surface of the pressure drum for preventing said intermediate transfer roller from contacting the gripper.

10. The thermal transfer printer according to claim 5, wherein the cam sections have a radially outward convex curved shape, and the length of the bases of the cam sections is greater than the distance between two edges between the circumference of said pressure drum and the flat surface formed by cutting a portion of the circumference of said pressure drum.

11. The thermal transfer printer according to claim 5, wherein the end plates further comprise a circumference section having a circumference less than a circumference of said pressure drum.

* * * * *